US006142040A

United States Patent [19]

Bouligny

[11] Patent Number: 6,142,040

[45] Date of Patent: Nov. 7, 2000

[54] DIRECT COUPLED TONG AND SPIDER

[75] Inventor: Vernon J Bouligny, New Iberia, La.

[73] Assignee: Franks Casing Crew and Rental Tools, Inc., Lafayette, La.

[21] Appl. No.: 09/330,408

[22] Filed: Jun. 11, 1999

[51] Int. Cl.[7] ..... B25B 13/50

[52] U.S. Cl. ..... 81/57.34; 81/57.16

[58] Field of Search ..... 81/57.15, 57.16, 81/57.17, 57.18, 57.19, 57.24, 57.2, 57.21, 57.34, 57.35

[56] References Cited

U.S. PATENT DOCUMENTS

| | | | |
|---|---|---|---|
| 3,771,389 | 11/1973 | Coyne | 81/54 |
| 3,780,815 | 12/1973 | Barron et al. | 173/43 |
| 4,545,269 | 10/1985 | Lemaire et al. | 81/57.34 |
| 5,081,888 | 1/1992 | Schulze-Beckinghausen | 81/57.16 |
| 5,099,725 | 3/1992 | Bouligny, Jr. . | |
| 5,161,438 | 11/1992 | Pietras | 81/57.16 |
| 5,259,275 | 11/1993 | Schulze-Beckinghausen | 81/57.16 |
| 5,664,310 | 9/1997 | Penisson | 29/407.02 |
| 5,842,390 | 12/1998 | Bouligny et al. | 81/57.34 |

*Primary Examiner*—Timothy V. Eley
*Assistant Examiner*—Dung Van Nguyen
*Attorney, Agent, or Firm*—John D. Jeter

[57] ABSTRACT

A spider, preferably a flush mounted spider, and powered lead tong are coupled by a rotationally rigid structure so that torque reaction forces apply no side load to pipe. The tong preferably tilts upward to clear larger objects approaching the spider. An optional grabber is mounted, preferably atop the lead tong, and may tilt with the lead tong. Fluid powered motors, linear or rotary, provide the tilting energy and extend and retract the grabber. The tong and related structure has quick coupler provisions for removal from the spider.

13 Claims, 2 Drawing Sheets

DIRECT COUPLED TONG AND SPIDER

This invention pertains to apparatus usable on a drilling rig to combine the structures of a spider and a power tong to manipulate the connections between pipe sections for assembling and dismantling pipe strings. More specifically the spider acts as a back-up tong and the coupled tong is a powered lead tong for making up and breaking out threaded connections.

The disclosed structure connecting tong and spider in this invention is symbolic of any structure that provides a suitable connection. Therefore, U.S. Pat. No. 5,099,725 is by reference herein made part of this application.

BACKGROUND

For descriptive clarity and to avoid repeated references to the alternative use of apparatus of this invention it will be described in conjunction with the usual oil field operations related to tubular strings joined by serial threaded connections. It will be understood that such tubing strings are representative of any threadedly connected machine elements manageable by the apparatus.

Historically, pipe string make-up, in well strings, was a combination of individual actions that used a cat head to add pulling power to the torque arm of tongs. Torque was produced by a force couple consisting of pull on the torque arm, an opposite force on the pipe being manipulated, and the space between those force vectors. The tongs were suspended and counterbalanced, but they were otherwise man handled.

Power tongs have come into widespread use in recent years and can be defined as tongs with bodies in which the pipe gripping dies rotate relative to the tong frame and about the gripped pipe centerline. Early power tongs still had the torque arm, snubbed to rig structure, and corresponding side loads on pipe still resulted from applied torque. The lateral load represents an undesirable, and sometimes unacceptable, side load on the pipe being assembled or dismantled.

Tongs in general oil field use have achieved definitions as lead tongs which rotate a pipe section relative to earth and back-up tongs which hold a pipe section stationary relative to earth. In operation, the relative rotation between the two tongs provide the relative rotation between pipe sections necessary to run threads to make up and break out threaded connections. Powered lead tongs have pipe rotating motors. Back-up tongs usually have power applied to closing the dies on pipe but usually do not have pipe rotating power.

Some tong sets are a close coupled pairing of lead and back-up tongs. The set then transmits torque between the tongs and no conventional external force acting on a torque arm is required on either tong. Ideally, the torque transmitted between tongs is pure torque. In that case, the torque alone would not produce a side load on pipe. The structure connecting the early tong sets was rather rigid, however, and could produce pure torque only if all gripping and gripped surfaces rotated true about the same axis. In the field of pipe string assembly, geometric perfection is rare and side loads on pipe can result from geometric irregularities. With geometric irregularities present, the more rigid the structure connecting the tongs the more severe is the resulting lateral loads.

The side loads became recognized as a complicating factor in torque measurement, and the side loads sometimes damaged the threads being mated. Tong sets with connecting structures arranged to apply pure torque to connections, with or without geometric irregularities, are in the art. One example of such structure is taught by U.S. Pat. No. 5,099,725 issued Mar. 31, 1992. Thread runs in either direction require some form of freedom of relative axial movement between tongs. In this example, there are two other degrees of freedom, or float, along perpendicular horizontal axes.

Spiders are the contrivances that are supported by the derrick floor structure, and support a suspended pipe string. The spider gains gripping power by applying at least part of the pipe string load to the mechanism that forces the dies onto the pipe surface. The flush design spider rests in, or at least occupies, the rotary table recess and is preferably flush with the derrick floor. Most spiders have fluid powered cylinders that open and close the pipe gripping dies, or slips. When the pipe load is large, the spiders designed to do so will grip the pipe rotationally and can function as a back-up tong. Spiders exist that have enough slip closing force provided by fluid power to allow the spider to function as a back-up tong without depending upon pipe load to close the slips.

The dynamics of a suspended length of pipe makes the final alignment of the length with the pipe string coupling near the center of the spider a very time consuming manual activity. The suspended pipe, approaching a vertical situation tends to oscillate laterally and immediate close control of such massive loads is beyond the realm of efficient manual handling. That particular aspect of pipe string handling is time consuming and dangerous.

A grabber is a machine assembly that extends an arm and pipe clutching means some distance toward an approaching pipe section, closes clutch jaws, or the "clutch", about the pipe and moves it toward the extended centerline of the tong to stab the connection.

SUMMARY OF INVENTION

A spider, preferably a flush mounted spider, and powered lead tong are close coupled with the lead tong reaction torque directed to the spider such that the tong has no side drift, caused by force coupling, resulting from torque application. The lead tong may tilt upward to allow large rig related elements and drill string components to approach the spider. An optional grabber is, preferably, mounted on the lead tong frame and is tilted, with the tong, to clear the area immediately around the extended well centerline.

The preferable spider-to-tong structure accepts tong produced torque and transmits it to the spider without applying side loads to the pipe. The ability of the structure to transmit torque between tong and spider without applying side load to the pipe is not a point of novelty with the present invention. To avoid side loads between pipe and tong the tong may have to move some amount about the spider centerline because the pipe itself may not be perfectly symmetrical about it's centerline. The limited lateral movement ability is often called "float". The float feature can be supplied by using the tong support structure of the referenced U.S. Pat. No. 5,099,725. The structure of this reference allows limited float, or free movement, along three mutually perpendicular axes, one axis being vertical. The referenced patent teaches it's use between lead and back-up tongs.

At least some of the actions of the invention may be powered. A fluid powered motor, linear or rotary, may be provided to tilt the tong upward to clear the spider area. If the grabber is in place atop the tong, it is tilted as part of that assembly. Fluid power motors, linear or rotary, may also extend the grabber, close the grabber clutch, and urge the clutched pipe length into the tong gripping area. The grabber can function as a pusher to move the pipe length out of the lead tong area when pipe is being removed from the well.

The spider with sufficient power closing the slips can function as a back-up tong at all times and the lead tong can be directly connected to the spider. Tong sets have to be readily removable from the vicinity of the well bore centerline to facilitate other activities. With the tong set easily removed, the lead tong can also be arranged for direct connection to the spider only after the suspended pipe load will adequately load the dies of the spider without providing powerful slip closing cylinders. That is anticipated by and is within the scope of the claims.

The close coupled powered lead tong and spider arrangement presents a small package above the spider and invites tilting the lead tong upward to clear the area near the pipe centerline. Pipe handling features, such as elevators, moving near the spider, and pipe components such as stabilizers moving through the rotary table need clearance. To clear large structures, the lead tong occasionally needs to be moved away from the gripping position, and quick coupling features are necessary but the quick tilting of the tong, now possible, is an added convenience.

It is often necessary to move the power tong away from the rotary table area and quick separation capability of tong and spider is provided. Quick coupling means are in the art and are provided between the spider and the structure that supports the power tong. Balls and quick opening sockets are often favored but pin secured mating parts, as shown, are one option. In many cases the tong and it's supporting structure are set aside after each connection.

The grabber normally allows vertical slippage of the pipe through the clutch means. It also moves the clutch means toward and away from the well centerline and can easily clear large machine elements moving along the well centerline without tilting. The lead tong frame is only one mounting possibility and the grabber does not have to be supported by the spider structure. The grabber mount on the lead tong frame is symbolic of any mount. That arrangement is anticipated by and is within the scope of the claims.

It is an object of this invention to provide apparatus to directly couple a powered lead tong to a spider frame for a drilling rig.

It is yet another object of this invention to provide a close coupled powered lead tong and spider with a grabber arrangement to urge and direct a suspended pipe string section into the power tong gripping area.

It is still another object of this invention to provide quick coupling means between spider and tong to permit removal of machinery above the spider to clear the area for other activity.

It is still another object of this invention to provide for tilting the power tong and coupled grabber to quickly clear the pipe passage area.

These and other objects, advantages, and features of this invention will be apparent to those skilled in the art from a consideration of this specification, including the attached claims and appended drawings.

BRIEF DESCRIPTION OF DRAWINGS

In the drawing wherein like features have similar captions.

DETAILED DESCRIPTION OF DRAWINGS

Figure 2:
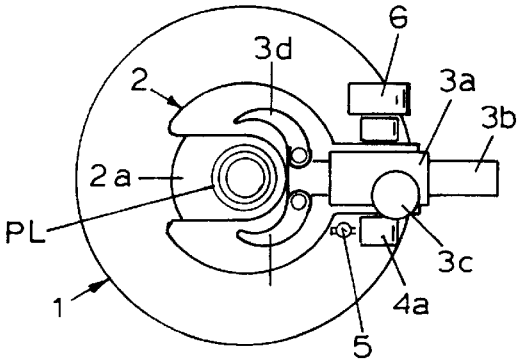
FIG. 2 is a top view, and a projection from FIG. 1.

In the drawings some features having no bearing upon points of novelty, are in the art, and contribute nothing to descriptive clarity are omitted in the interest of clarity of points of novelty and descriptive efficiency. Such omitted features may include some threaded junctions, weld lines, some fasteners, and fluid power and control lines for fluid powered aspects of the apparatus.

Figure 1:
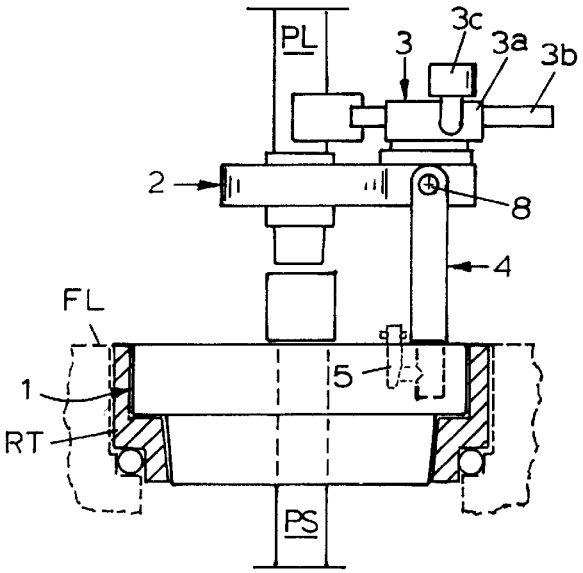
FIG. 1 is a side view of the preferred embodiment.

In FIG. 1 the apparatus is shown prepared to spin pipe length PL into the connector of the suspended pipe string PS. Spider 1 grips pipe string PS for vertical support and secures the pipe string rotationally. Powered lead tong 2 is in operating position some distance above the spider on support 4. Support 4 is symbolic. The preferred support carries torque between lead tong and spider and allows some movement along three axes (x, y, and z). The preferred support is described in the referenced U.S. patent referred to herein as U.S. Pat. No. 5,099,725. Optional pipe grabber 3 is, preferably, secured atop the tong. The grabber base structure 3*a* is shown attached directly to the lead tong frame. The grabber support can be mounted independently of the lead tong and the spider by structure well established in the art. The rotary table RT is symbolic. Such tables differ among the rigs in use.

Figure 4:
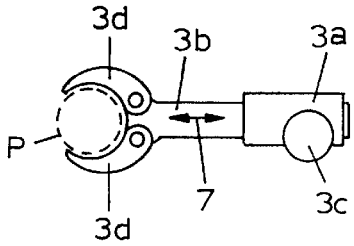
FIG. 4 is a view of a selected functional assembly extracted from FIG. 2 showing an alternate position.

Considering FIGS. 2 and 4, the grabber reaches out some distance to clutch a suspended pipe length and pulls it in through tong gap 2*a* to the position shown in FIG. 2. Not all lead tongs have gaps, in which case the pipe is pulled into general alignment with the tong opening which is generally centered above the pipe string PS. Clutch jaws 3*d* open as shown in FIG. 2 and the lead tong spins up the pipe length to make up threads into the box of the suspended pipe string. In normal operation, the pipe is then picked up by the elevators (not shown), the spider slips (not shown) are released, and the pipe string is lowered to the position shown in FIG. 1, the spider slips are set, and a new length of pipe is brought in to duplicate the situation shown in FIG. 1, and the process is repeated to assemble a continuing pipe string.

In the usual situation on small rigs, the pipe lengths to be added to the string are hoisted by secondary lift means (not shown) and the pipe is otherwise man handled to the range of the grabber. Operating personnel then stand clear as the balance of the operation proceeds under the manual control of a console operator who manipulates the valves to drive the grabber, lead tong, and spider slips.

The entire assembly above the spider can be removed and set aside by releasing the structure 4 from the spider when the latch pins 5 are lifted. The upper assembly is normally lifted by secondary hoist gear and a stowing position may receive the standards 4*a* of structure 4.

Figure 5:
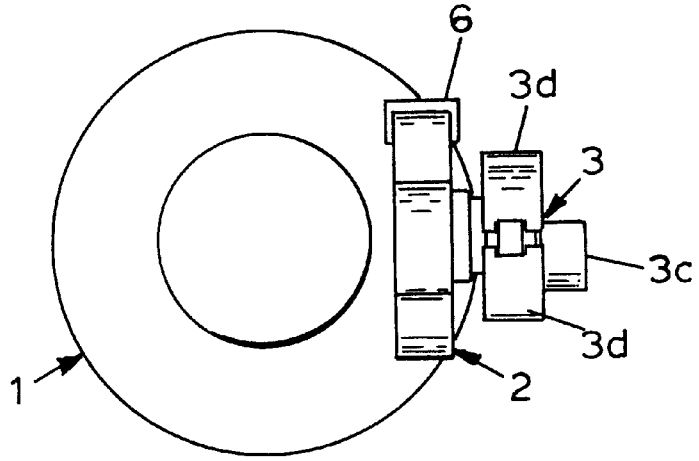
FIG. 5 is a top view identical to FIG. 2, with an alternate position of part of the apparatus and is a projection of FIG. 6.
Figure 6:
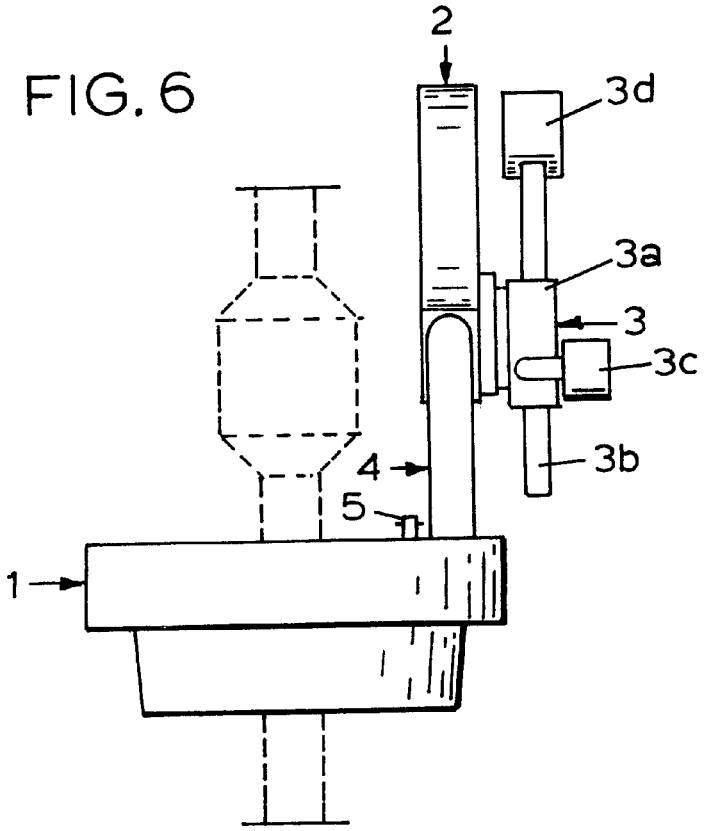
FIG. 6 is a view identical to FIG. 1 but showing an alternate position of part of the apparatus.

The tong and grabber assembly has to be moved clear of the pipe gripping position when the elevator, or oversize string components, approach the spider. The tong and grabber assembly can be removed from the spider or tilted upward about axis 8. Tilting is shown by FIGS. 5 and 6. The tilting of the tong frame is, preferably, done by a fluid motor arrangement, either rotary or linear. The rotary option is shown as motor 6.

The grabber is moved laterally, to acquire a pipe length and pulls it into position to be spun, by fluid motor 3*c*. A rotary motor option is shown but linear motors, cylinders, may be used by design preference. The grabber clutch jaws 3*d* are operated by a linear motor in the arm 3*b*. Motion of the grabber arm is indicated by arrow 7 in FIG. 4.

Figure 3:
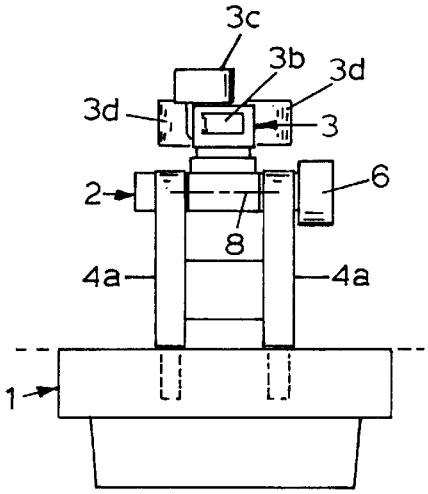
FIG. 3 is a back view of the apparatus, and a projection from FIG. 1.

A lead tong frame tilt axis 8 is shown in FIGS. 1 and 3. The tong assembly, when set aside may be in the tilted position or horizontal as shown in FIG. 1.

From the foregoing, it will be seen that this invention is one well adapted to attain all of the ends and objects hereinabove set forth, together with other advantages which are obvious and which are inherent to the tool.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

What is claimed is:

1. A pipe handling apparatus usable on derrick floors for assembly and dismantling of pipe strings suspended in wells, the apparatus comprising;

a) a spider for pipe suspension, having a frame and a generally central bore with a centerline, arranged to occupy the opening of a rotary table;

b) a powered lead tong c) a rotationally rigid, torque transmitting structure arranged to provide support for said lead tong, to support said lead tong a selected distance above said spider and to convey pipe turning reaction torque therethrough; and d) latch means to releasably secure said structure to said frame of said spider.

2. The apparatus of claim 1 wherein said structure provides limited freedom of movement, of the lead tong relative to the spider, along three mutually perpendicular axes, one of said axes being vertical.

3. A pipe handling apparatus usable on derrick floors for assembly and dismantling of pipe strings suspended in wells, the apparatus comprising;

a) a rig supported spider for pipe suspension, having a frame and a generally central bore with a centerline;

b) a powered lead tong arranged with a frame having trunnions for mounting and tilting about a horizontal axis;

c) a rotationally rigid, torque transmitting structure arranged to provide support for said trunnions, to support said power tong a selected distance above said spider for pivoting about said horizontal axis; and d) latch means to releasably secure said structure to said frame of said spider; and e) a pipe grabber secured to said lead tong frame.

4. The apparatus of claim 3 wherein said grabber has an extendible arm with clutch means at one end to releasable clutch pipe to be moved laterally by movement of said arm.

5. The apparatus of claim 4 wherein said grabber arm is extended and retracted by at least one fluid powered motor.

6. The apparatus of claim 4 wherein said clutch means is actuated by at least one fluid powered motor.

7. The apparatus of claim 3 wherein said spider is a flush mounted spider which occupies at least the rotary table opening on a rig floor.

8. A pipe handling apparatus usable on derrick floors for assembly and dismantling of pipe strings suspended in wells, the apparatus comprising;

a) a rig supported spider for pipe suspension, having a frame and a generally central bore with a centerline;

b) a powered lead tong arranged with a frame having trunnions for mounting and tilting about a horizontal axis;

c) a rotationally rigid, torque transmitting structure arranged to provide support for said trunnions, to support said powered lead tong a distance above said spider for pivoting about said horizontal axis;

d) attachment means to releasably secure said structure to said frame of said spider; and e) a pipe grabber secured to said spider.

9. The apparatus of claim 8 wherein said grabber has a horizontally extendible arm with clutch means at one end to releasable clutch pipe to be moved laterally by movement of said arm.

10. The apparatus of claim 9 wherein said arm is extended and retracted by at least one fluid powered motor.

11. The apparatus of claim 8 wherein said powered lead tong is tiltable about said trunnion axis approximately ninety degrees by at least one fluid powered motor.

12. The apparatus of claim 8 wherein said spider is mounted generally flush with a derrick floor and situated within the opening of a rotary table.

13. The apparatus of claim 8 wherein said grabber is secured to said spider by way of structure secured to the rig floor.

* * * * *